US005271131A

United States Patent [19]

Jacumin

[11] Patent Number: 5,271,131

[45] Date of Patent: Dec. 21, 1993

[54] CONTINUOUS FABRIC DETWISTER

[76] Inventor: Jimmy R. Jacumin, P.O. Box "A", Icard, N.C. 28666

[21] Appl. No.: 889,959

[22] Filed: May 29, 1992

[51] Int. Cl.[5] ..... D06C 3/00

[52] U.S. Cl. ..... 26/87; 26/74; 26/80; 57/1 UN

[58] Field of Search ..... 26/80, 81, 87, 18.5, 26/18.6, 51, 51.3, 101, 71, 74; 57/1 UN; 68/13 R, 22 R; 8/150, 151

[56] References Cited

U.S. PATENT DOCUMENTS

| | | | |
|---|---|---|---|
| 2,652,615 | 9/1953 | Lasley | 57/1 UN |
| 2,759,324 | 8/1956 | Dean | 57/1 UN |
| 3,624,874 | 12/1971 | Lauchenauer | 26/51 |
| 4,285,694 | 8/1981 | Itoh et al. | 8/151 |
| 4,329,838 | 5/1982 | Zerk et al. | 57/1 UN |
| 4,631,911 | 12/1986 | Young, Jr. et al. | 57/1 UN |
| 4,747,190 | 5/1988 | Koch | 26/80 |
| 4,766,719 | 8/1988 | Young, Jr. | 57/1 UN |
| 4,843,669 | 7/1989 | Koch et al. | 26/80 |

FOREIGN PATENT DOCUMENTS

| | | | |
|---|---|---|---|
| 3135452 | 3/1983 | Fed. Rep. of Germany | 57/1 UN |
| 1416560 | 8/1988 | U.S.S.R. | 57/1 UN |

*Primary Examiner*—Clifford D. Crowder
*Assistant Examiner*—Amy B. Vanatta
*Attorney, Agent, or Firm*—Roy B. Moffitt

[57] ABSTRACT

A device for continuously imparting a predetermined twist to an elongated tubular shaped flaccid work piece composed of first and second sets of arcuate shaped spaced apart ribs delimiting a space having a funnel shaped portion, a moving device affixed to the first and second set capable of moving the first and second set of ribs in misalignment with one another, and a device for supplying gas under pressure to the space delimited by the first and second sets of ribs.

18 Claims, 4 Drawing Sheets

CONTINUOUS FABRIC DETWISTER

BACKGROUND OF THE INVENTION

The field of the invention relates to the continuous bleaching, dyeing and finishing of an elongated mass of flaccid material, particularly a tubular mass of circular knitted fabric such as cotton or a blend of two or more materials, and the apparatus for doing so like that disclosed in U.S. Pat. No. 5,119,646, the contents of which are incorporated hereby by reference. During the knitting of a piece of tubular flaccid material, torque (a twist) is inherently imparted to the fabric. In a subsequent operation, where the tubular mass is worked upon, such as in a bleaching kier, this twist becomes a processing deterrent, causing the elongated mass to "kink up" into knots to the extent that the effectiveness of the operation sought to be carried out on the flaccid material (bleaching for example) is materially reduced. Because of this inherent twist and undesirable consequence during bleaching in a bleaching kier, at least one prior art technique has been developed to remove it, namely, a turntable apparatus and a semi-batch process to remove the torque in the fabric.

The present invention deals with the problem of removal of twist or torque in an elongated mass of flaccid material, but in a continuous and much more efficient manner with a minimum amount of equipment, compared to prior art methods and apparatus.

SUMMARY OF THE INVENTION

The invention is a detwisting apparatus, having its primary utility in the continuous in line treatment of an elongated mass of flaccid material, especially tubular shaped knitted fabrics undergoing bleaching, dyeing, and finishing operations. The detwister itself may be used, but is not so limited, between a bleaching kier and a washer and is usually employed in conjunction with a downstream set of squeeze rolls or some other type of conveyor of elongated tubular flaccid material. Specifically, the detwister comprises a support, which may be a funnel shaped chute, which acts as a support for the detwisting elements and the detwisting elements themselves, and first and second sets of bow shaped (arcuate) ribs. The rib sets are spaced apart from one another so that they delimit a space (within the support), at least a portion of which is funnel shaped, through which the elongated flaccid mass is traversed. Connected to the sets of ribs is a moving device (specifically a rack and pinion gear) attached to rods which are attached to the ribs and are so adapted to move the sets of ribs into a misalignment with one another. One or more of the ribs have apertures in them and such apertures are connected to a source of gas under pressure so that gas may be forced into the tubular flaccid mass causing it to expand to the extent dictated by the space delimited by the ribs. The above described combination creates a "screw like effect" on that portion of the air-expanded elongated tubular-shaped flaccid material passing through the space delimited by the two sets of ribs thus continuously imparting to the flaccid mass a predetermined twist. By making this twist opposite to that which is inherently in the flaccid mass itself, a detwisting effect is achieved on a continuous processing basis sufficient in extent to keep the elongated flaccid mass from knotting or "kinking" up during processing, thus rendering the process sought to be carried out more effective than it would otherwise be.

DETAILED DESCRIPTION OF THE INVENTION

Figure 1:
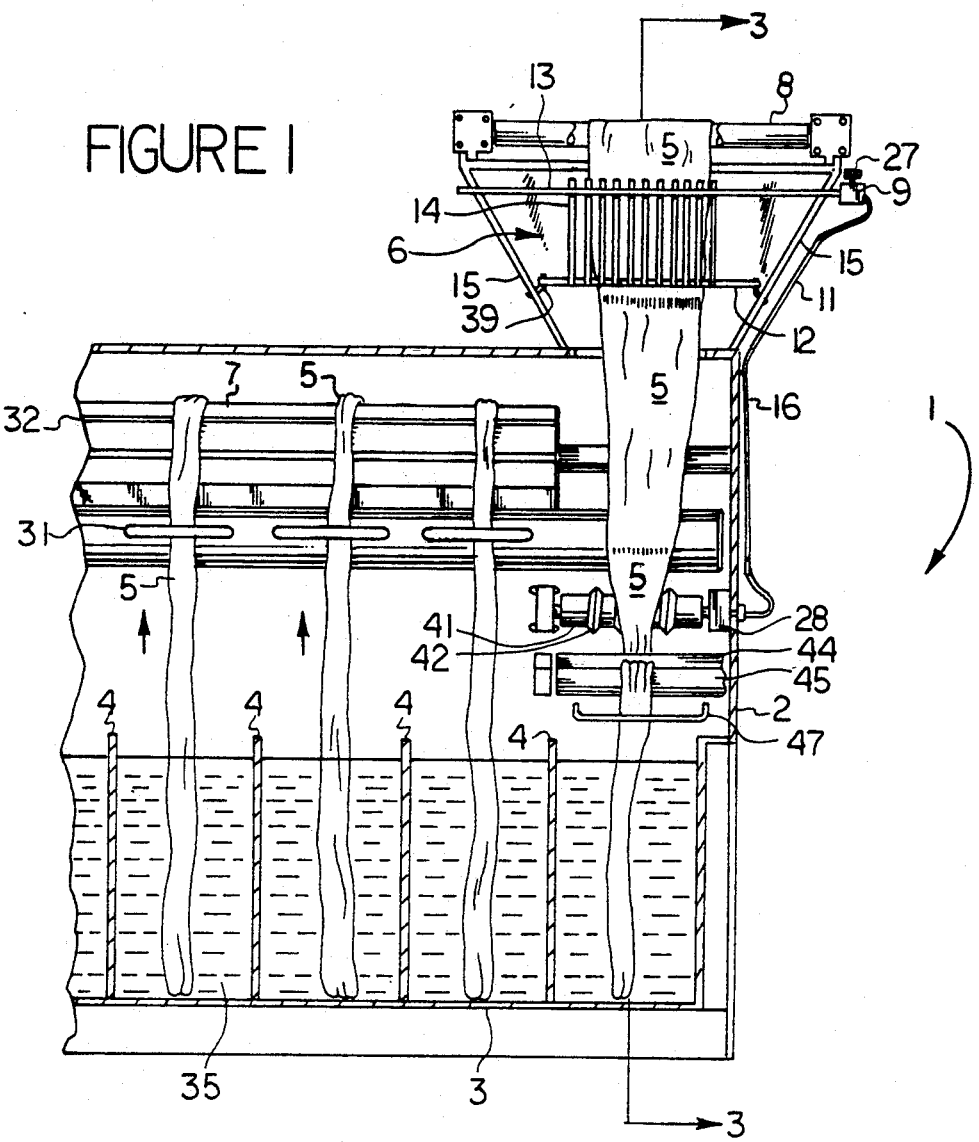
FIG. 1 is a partial cross section of a front elevation view of a bleaching kier employing the detwister invention.

Referring to FIG. 1, the invention disclosed hereinafter is shown by element 1 in an environment where it has its intended utility, namely, a bleaching kier for the bleaching, dyeing, and finishing of an elongated tubular shaped piece of flaccid material 5. Flaccid material 5 in a bleaching kier is traversed back and forth through a plurality of troughs, formed by two upstanding elements 4, then up through guide member 31 and over conveyor 7, which can be, and is shown in FIG. 1 to be, a rotatable drum 7 on which there is shown to be upstanding members 32. Tubular flaccid member 5 is traversed from back to front of the kier and moved from one trough formed by elements 4—4 from the left hand side through successive like troughs until it reaches the lateral trough on the right hand side. Thereafter it emerges from liquor 35 of the kier through guide member 47 over roll 45, under roll 44, and twist sensor 41, 42 into detwister 6, shown in the upper right hand corner of FIG. 1. Bleaching kier 1 is comprised of sidewalls 2, upstanding members 4, guide members 31 and control or conveyor 7 previously described. In addition, bleaching kier 1 contains an exit chute 15 at least a portion of which is funnel shaped as shown in FIG. 1. Detwister 6 is disposed in exit chute 15.

Just prior to the flaccid tubular material 5 entering into detwister 6, it is traversed through loop guide 47 (disposed on a frame composed of element 48) over roller 45, under roller 44, then over a twist sensor composed of roller 41 having upstanding ribs 42, used to detect twisting in flaccid member 5. If there is a twist in flaccid member 5, elements 41 and 42 detect it and cause a signal to be sent via transmitter 28 through lead 16 to detwister 6, which acts in response thereto to misalign ribs 14 (one set of ribs compared to another set), so as to counteract and detwist fabric 5 as more fully explained hereafter. Element 13 (FIG. 4) is a source of air and is used to supply air through hoses 17 and 28 to outlets 18–19 to expand flaccid member 5 as it is entering detwisting apparatus 6. Tubular flaccid fabric 5 is traversed upwardly along its exit path from bleaching kier 1 by means of squeeze rolls 8. See FIG. 3. Loop guide 47 and rollers 44, 45 tend to keep the air, supplied by outlets 18–19, inside of tubular flaccid material 5 and upstream of rollers 44 and 45.

Figure 2:
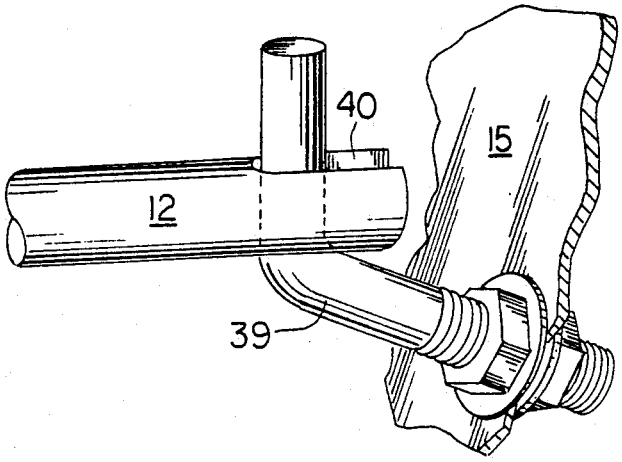
FIG. 2 is a detailed perspective view of a terminal portion of lower rod fixture of the detwister affixed to a support.
Figure 3:
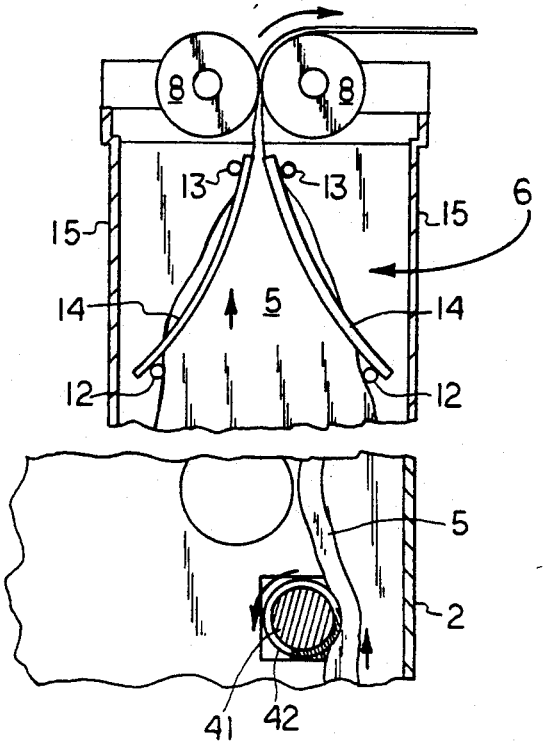
FIG. 3 is a cross-section along lines 3—3 of FIG. 1.
Figure 4:
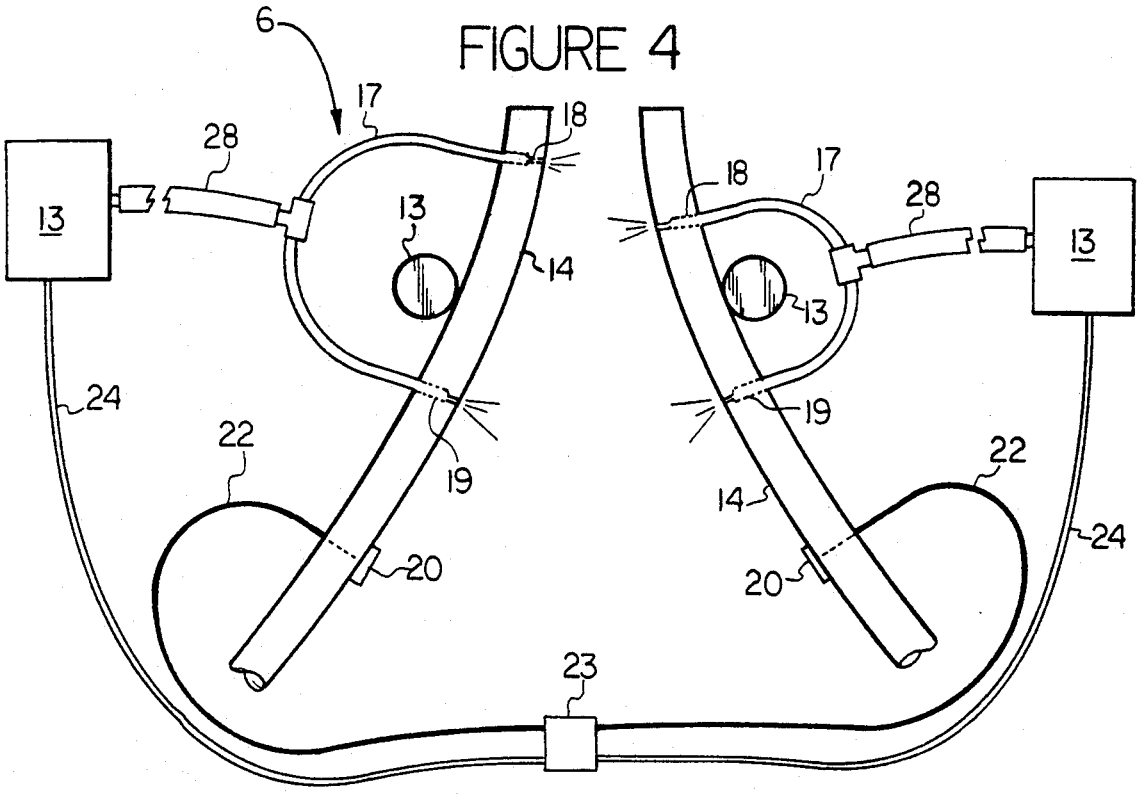
FIG. 4 is an enlarged and more detailed view of the detwister invention shown in FIG. 3.

Shown in FIGS. 3 and 4 are more detailed views of detwister 6. It will be noted that detwister 6 is composed of a first set of spaced apart upper rods 13 and a second set of spaced apart lower rods 12. Rods 12 and 13 are affixed to a first and a second set of ribs 14. Namely, rod 12 is affixed to the lower terminal portions of a plurality of ribs 14 and rod 13 is affixed to the upper terminal portions of ribs 14, forming a first set of ribs. A like second set is also formed from like elements. First and second sets of such ribs are positioned so that rods 13 are spaced apart from one another and rods 12 are also spaced apart from one another, but rods 12 are spaced apart a greater distance than rods 13. Rods 12 are affixed to sidewall 15 by means of a slot 40 in the terminal portion of rods 12 of each of the rods 12 in which are slidably fitted L-shaped member 39, a portion of which is affixed to side-wall 15. Rods 12 are essentially affixed, movable only within the limits of the slot 40, to sidewall 15. See FIG. 2.

In FIG. 4, the detwister mechanism is shown in further detail, more particularly apparatus relating to an air supply 13 being connected to hoses 28 and 17 which are connected to supply ports 18–19 within the ribs 14 themselves. Air supply 13 is programmed so that a given or first level of air is supplied from air supply 13 through conduit 28 into tubular member 17 and through air holes 18 and 19, as shown in FIG. 4. Also shown in FIG. 4, by elements 20, are sensors 20 which are affixed to a bottom terminal portion of one or more ribs 14. Sensors 20 are responsive to the non contact of flaccid member 5 with them, which would take place in the event there was a hole in tubular member 5, allowing the escape of air and preventing the enlargement of tubular member 5. In the event there is a hole in flaccid member 5, air supply 13 at the first level of supply would be unable to supply sufficient air through supply ports 18 and 19 to enlarge (blow up) the flaccid tubular member 5. See FIGS. 6 and 7. Lacking such enlargement, there would be no contact by tubular member 5 with sensors 20. This would cause tubular member 5 not to be twisted in the direction opposite of the inherent twist in tubular member 5 by misalignment of rod members 14 as explained below. Non contact of tubular member 5 with sensor 20 will activate activator 23 which in turn causes a second level of air supply (higher) to be supplied through air supply 13, tubular members 24, 28 and 17, and supply ports 18 and 19 in ribs 14, thus forcing the tubular member 5, notwithstanding a hole therein, to be pressed against rib members 14 in a manner like that shown in FIGS. 6 and 7.

Figure 5:
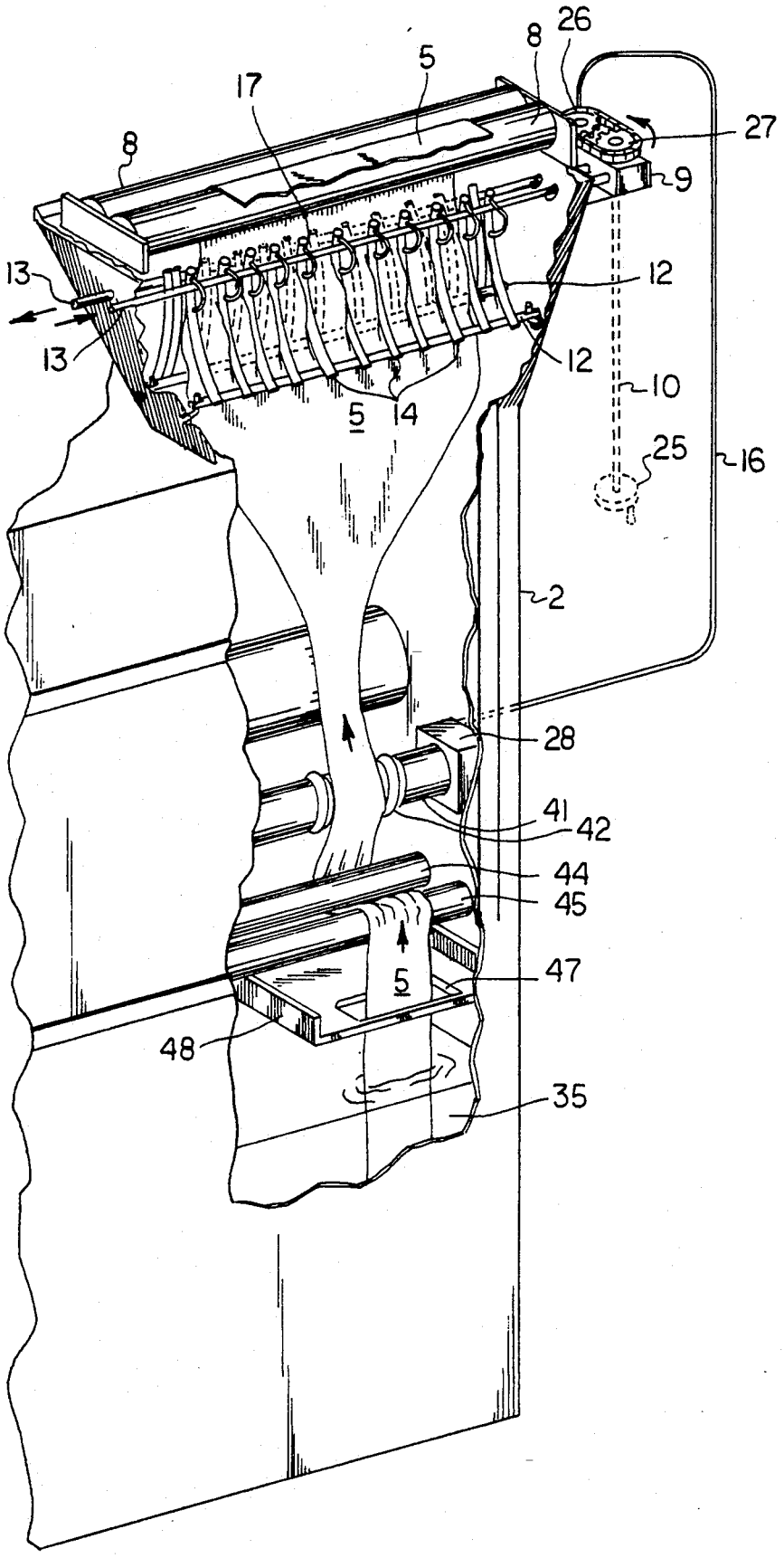
FIG. 5 is a fragmentary cut-away prospective view of a bleaching kier employing the detwister invention.
Figure 6:
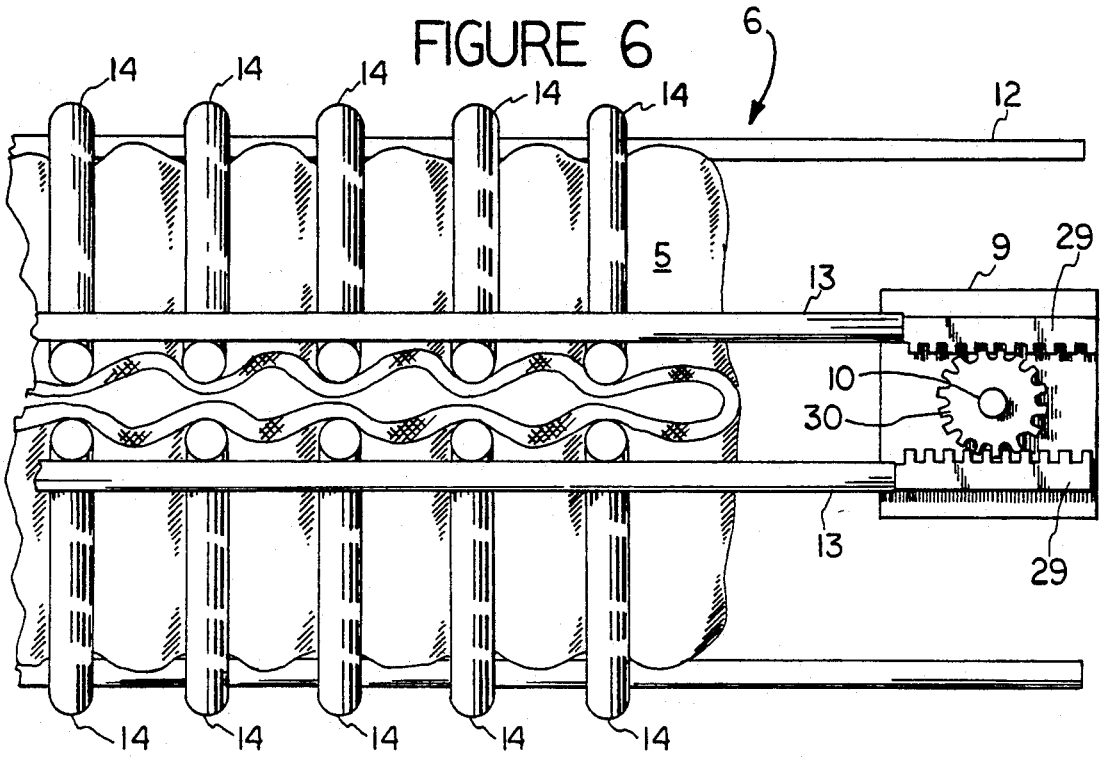
FIG. 6 is a plan view of the elements of the twisting portion of the invention showing the ribs of the detwister in an alignment with one another.
Figure 7:
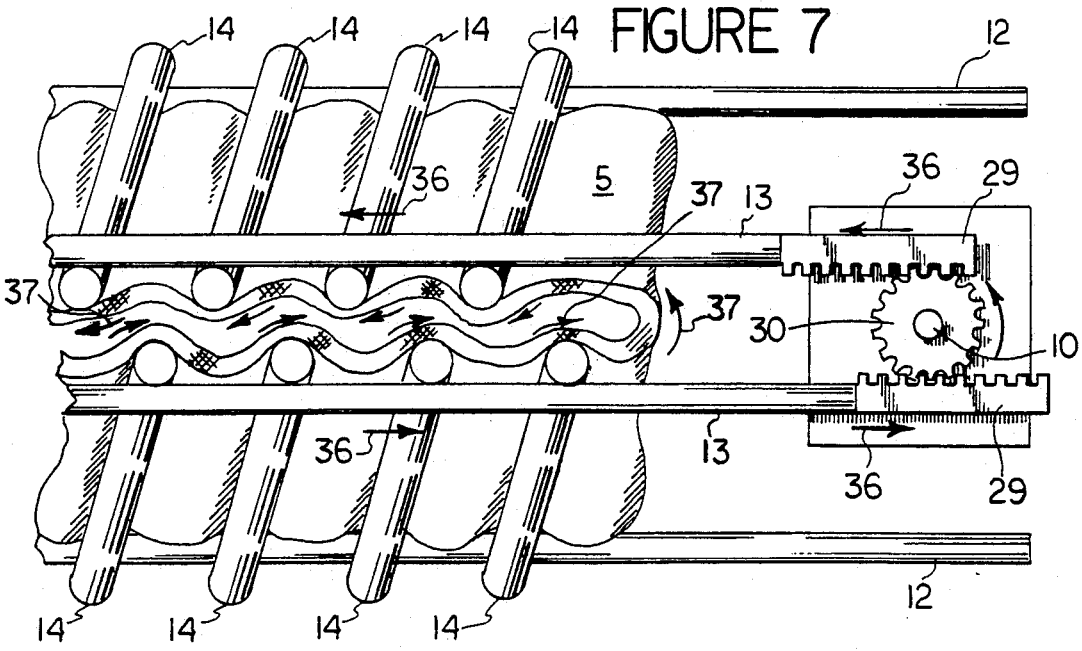
FIG. 7 is a plan view of the elements of FIG. 6 showing the ribs of the detwister in non alignment with one another.

In FIG. 5, there is shown a prospective view of a cut away portion of the end member of a bleaching kier employing the invention as previously described. Once twisting is encountered in flaccid member 5 by sensor 41–42, device 28 is activated, which through lead 16 activates a motor or other driving device to drive sprockets and chain combination 26 and 27, which in turn drives pinion gear 30, engaged with rack gears 29, both housed in housing 9. Rack gears 29 are affixed to upper rods 13. By moving rods 13 in the manner shown by arrows 36, ribs 14 of one set are misaligned with ribs 14 of the other and opposite set, creating or delimiting a screw shaped passageway. It is this screw shaped space that imparts a predetermined twist to flaccid member 5 as it traverses upwardly, pulled by rollers 8. FIG. 6 shows the ribs 14 of one set in alignment with one another. FIG. 7 shows the ribs 14 of one set in misalignment with the ribs 14 of another and opposite set. The misalignment of the ribs and their contact with flaccid means 5 causes a predetermined twist to be imparted to tubular flaccid means 5 as shown by the arrows 37, obviously such twist being equal and opposite to that inherent in tubular flaccid member 5. Thus, it will be appreciated that it is essential that the sidewalls of tubular flaccid means 5 be in contact with ribs 14.

Shown in FIG. 5 is another means (hand operated device 25) for controlling the alignment or misalignment of first and second set of ribs 14 and their respective upper and lower most rods 12 and 13. This device is a rotatable means which is affixed to pinion gear 30. When an operator rotates device 25, it rotates pinion gear 30 in a manner described by FIGS. 6 and 7 and in the same manner that has been previously described by elements 26 and 27 as shown in FIG. 5.

It will be appreciated that there has been described above a device for detwisting elongated flaccid material which includes a support, first and second sets of bow or arcuate shaped spaced apart ribs disposed on the support delimiting a space a portion of it being funnel shaped. A moving device such as that shown by elements 30 and 36 is attached to the first and second set of ribs to move the ribs of the first and second sets into a misaligned position with one another, delimiting a screw shaped space through which the flaccid member in an inflated state is traversed. The detwisting device also includes a device for supplying gas under pressure into the space delimited by the ribs. As shown in FIGS. 6 and 7 the moving device is a rack and pinion gear with the rack gear being attached to the terminal portion of the upper most rods 13. The lower most set of rods 12 are affixed to the support 15 by means of a slot, which provides for restricted movement, with "L" shaped member 39. Furthermore, the ribs are furnished with an aperture therein which is connected to a supply of gas such as air and such supply of gas is designed to deliver a supply at first and second levels. If and when one or more sensors disposed on lower terminal portion of rods 14 fail to come in contact with an inflated tubular flaccid member 5, a second and higher level of air is supplied.

Misalignment of the rod members 14 can be caused by either sensor 41 and 42 activating sprocket and chain 26 and 27, which in turn activates rack and pinion gears 30 and 29, or by rotating hand operated control devices 10 and 25 connected to pinion gear 30. Misalignment imparts a predetermined false twist to flaccid means 5, counter or opposite to the inherent twist either observed visually by an operator in flaccid means 5 or by sensors 41 and 42.

It will be also noted that the detwister described above includes a first and second set of arcuate rib members, each set having first and second rods to which the arcuate members are affixed in a spaced apart manner. First and second set of ribs are disposed relative to one another so that the first rod of the first set is spaced apart from the first rod of the second set and the second rod of the first set is spaced apart from the second rod of the second set by an amount greater than the distance the first rods are spaced apart from each other. The first and second set of ribs delimit a space having a funnel shaped portion. See FIG. 1. The rods affixed to the upper most portion of the ribs are movable relative to the lower most rods to cause the spaced apart ribs of the first set to be misaligned with the spaced apart ribs of the second set. One or more of the ribs have apertures in them, attached to a supply of gas under pressure providing a supply of gas into the space delimited by the ribs at a first level and at a second level if the flaccid material fails to come in contact with sensors or the ribs.

In all cases, it is to be understood that the above described embodiment is illustrative of one of many of the possible specific embodiments which may represent the principles of my inventions. Numerous and various other embodiments can be devised readily in accordance with these principles by those skilled in the art without departing from the spirit and scope of my invention.

What is claimed is:

1. A device for detwisting tubular shaped elongated flaccid material comprising:

(a) a support;

(b) first and second sets of arcuate shaped spaced apart ribs disposed on said support, defining a funnel shaped space between said first and second sets of ribs;

(c) a moving device affixed to said first and second sets of ribs to move the ribs of said first and second sets to a misaligned position with one another; and, (d) a device for supplying a gas under pressure into said tubular shaped elongated flaccid material while in said space.

2. The device of claim 1 wherein the moving device includes a first rod and a gear, said first rod attached to a terminal portion of said first set of spaced apart ribs and to said gear.

3. The device of claim 2 wherein the moving device further includes a second rod attached to a terminal portion of said second set of ribs and to another gear for moving said second rod in a lateral direction, opposite from that of said first rod.

4. The device of claim 3 further including a third rod affixed to another terminal portion of said first set of ribs and to said support.

5. The device of claim 4 further including a fourth rod affixed to another terminal portion of said second set of ribs and to said support.

6. The device of claim 1 wherein said device for supplying gas into said space includes one or more apertures in one or more of said ribs connected to a device for supplying gas under pressure to said apertures at a first level of supply.

7. The device of claim 6 further including a first sensor, disposed on one or more of said ribs, connected to said device for supplying gas under pressure at a first level of supply and responsive to non contact with said sensor by a flaccid member to increase said supply of gas to a level higher than said first level of supply.

8. The device of claim 7 further including a second sensor for detecting torque in the elongated flaccid material, said second sensor in contact with said moving device and responsive to a predetermined level of torque in said flaccid material to cause said moving device to move said first and second sets of ribs to a predetermined state of misalignment with one another.

9. The device of claim 1 wherein said support is an enclosure having one or more spaced apart sidewalls delimiting a continuous passageway, said device being disposed in said passageway.

10. The device of claim 9 wherein in a portion of said enclosure said spaced apart sidewalls diverge from one another forming a funnel shaped portion.

11. A device for detwisting an elongated piece of flaccid material comprising:

(a) a support;

(b) a detwister mounted on said support, said detwister including a first and second set of arcuate rib members, each set having first and second rods to which the arcuate rib members of a given set are affixed in a spaced apart manner, the first and second sets being disposed relative to one another so that the first rod of the first set is spaced apart from the first rod of the second set and the second rod of the first set is spaced apart from the second rod of the second set by an amount greater than the distance said first rods are spaced apart from each other, said first and second sets delimiting a space having a funnel shaped portion, said first rods being movable relative to each other to cause said spaced apart ribs of said first set to be misaligned with the spaced apart ribs of the second set, and one or more of said ribs having apertures therein attached to a source of gas under pressure for providing a supply of gas into said space at a first level of supply.

12. The device of claim 11 further including a first gear attached to said first rod of said first set of rib members for moving said first rod and the ribs attached thereto in a lateral direction.

13. The device of claim 12 further including a second gear attached to the first rod of said second set of rib members for moving said first rod and ribs attached thereto in a lateral direction, opposite from that of the first rod of said first set of rib members.

14. The device of claim 11 further including a first sensor, disposed on one or more of said ribs, connected to said source of gas under pressure, said sensor responsive to non contact therewith by a flaccid, member, to increase said supply of gas above said first level of supply.

15. The device of claim 14 further including a second sensor for detecting torque in the elongated piece of flaccid material, said second sensor in contact with said first rods and responsive to a predetermined amount of torque in said flaccid material to cause said first rods to move the ribs attached thereto to a predetermined state of misalignment with one another.

16. The device of claim 15 further including a moving device for moving said first rods and ribs attached thereto composed of a gear connected to said first rods and responsive to said second sensor.

17. The device of claim 11 wherein said support is an enclosure having one or more spaced apart sidewalls delimiting a continuous passageway, said device being disposed in said passageway.

18. The device of claim 17 wherein in a portion of said enclosure said spaced apart sidewalls diverge from one another forming a funnel shaped portion.

* * * * *